US008418842B2

(12) United States Patent
Palmer

(10) Patent No.: US 8,418,842 B2
(45) **Date of Patent: *Apr. 16, 2013**

(54) OBLONG OBJECT HOLDER

(75) Inventor: David H. Palmer, Winter, WI (US)

(73) Assignee: David H. Palmer, Winter, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/924,597

(22) Filed: Sep. 30, 2010

(65) Prior Publication Data

US 2011/0073509 A1 Mar. 31, 2011

Related U.S. Application Data

(60) Provisional application No. 61/277,801, filed on Sep. 30, 2009.

(51) Int. Cl.
*A45C 11/32* (2006.01)

(52) U.S. Cl.
USPC ..... 206/37.1; 206/37.5; 206/39.4

(58) Field of Classification Search ..... 206/37, 206/234, 37.1, 37.2, 37.5, 37.8, 39.1, 39.4
See application file for complete search history.

(56) References Cited

U.S. PATENT DOCUMENTS

| | | | | |
|---|---|---|---|---|
| 4,646,913 | A * | 3/1987 | Wing et al. | 206/37.2 |
| 5,177,989 | A * | 1/1993 | Stillwagon | 70/456 R |
| 5,215,190 | A * | 6/1993 | Hoffpauir, Jr. | 206/37.2 |
| 5,943,889 | A * | 8/1999 | Chiu | 70/456 R |
| 7,055,352 | B2 * | 6/2006 | Meyerson et al. | 70/456 R |
| 7,127,922 | B2 * | 10/2006 | Khounsombath et al. | 70/456 R |

* cited by examiner

*Primary Examiner* — J. Gregory Pickett
*Assistant Examiner* — Raven Collins
(74) *Attorney, Agent, or Firm* — David H. Palmer

(57) ABSTRACT

A holder of oblong objects pivotably mounted therein so as to be selectively positionable and selectively retainable therein comprising a pair of oblong sidewall structures spaced apart across an object retaining space from one another each having a mounting end such that a supporting one of the pair of sidewall structures has a divide extending therein partially along its length to provide a pair of split sidewall spring sheets across the divide from one another with each of the pair of sidewall spring sheets having a sidewall spring opening therethrough. An ejector is mounted in the holder positioned in the object retaining space at an ejector side of the object retaining space to extend between the pair of spaced apart oblong sidewall structures with the ejector formed of a resilient material. A pivot pin is positionable concurrently through each of the sidewall spring openings, and also removable therefrom.

11 Claims, 5 Drawing Sheets

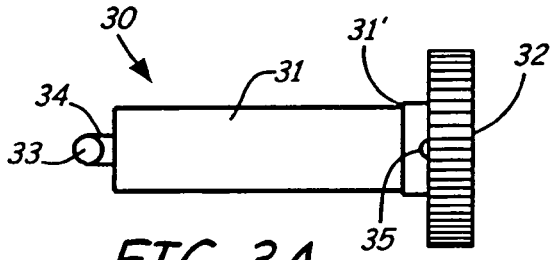
FIG. 3A
FIG. 3C
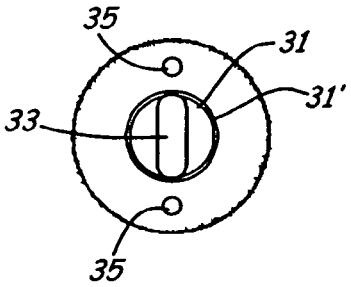
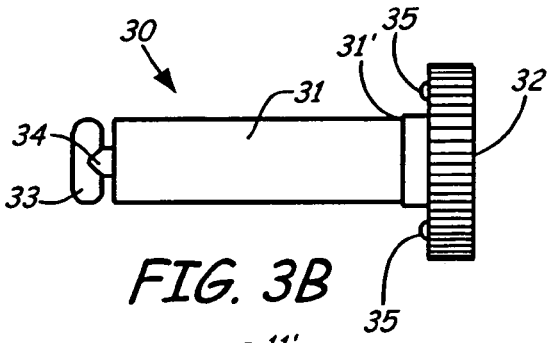
FIG. 3B
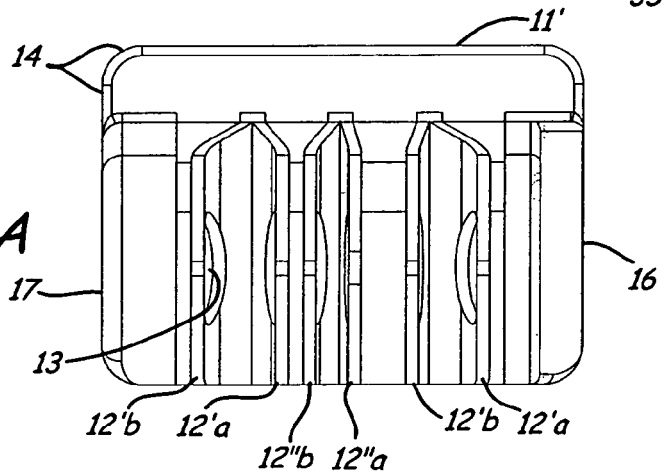
FIG. 4A
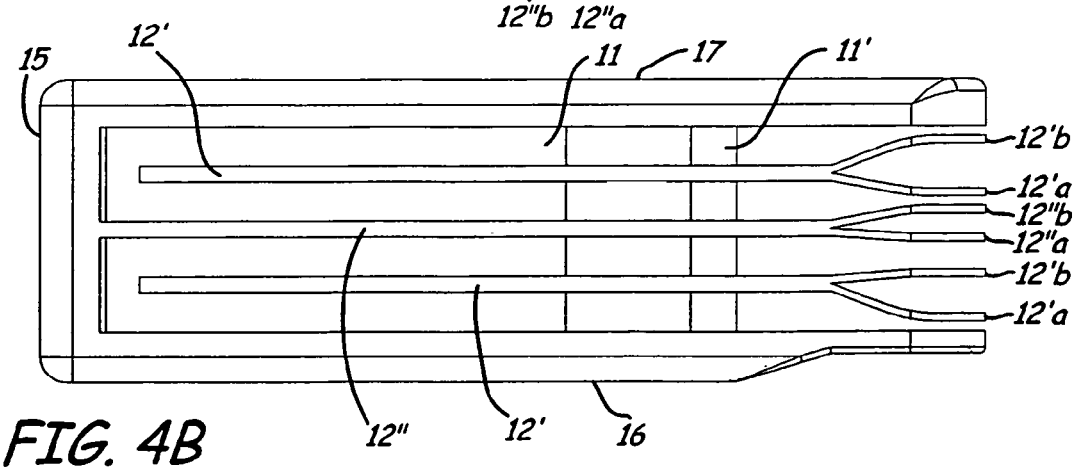
FIG. 4B

OBLONG OBJECT HOLDER

CROSS-REFERENCE TO RELATED APPLICATION(S)

This application claims the benefit of Provisional Patent Application No. 61/277,801 filed Sep. 30, 20009 for OBLONG OBJECT HOLDER, which is incorporated herein in its entirety by reference. This application is related to the following co-pending applications that are filed on even date herewith and are commonly owned: OBLONG OBJECT HOLDER, Ser. No. 12/924,598; and OBLONG OBJECT HOLDER, Ser. No. 12/924,596. The disclosures of these applications are incorporated herein by reference in their entirety.

BACKGROUND

The present invention relates to oblong object holders and, more particularly, to oblong object holders which have one end of the objects free while also being held at the other end thereof.

Many people have needs for keeping a variety of oblong objects with them as they go about their various daily activities, objects such as keys, nail files or other tools shaped oblong by handles or tool structures therein, electronic memory devices having electrical interconnections plugs at one end thereof, and the like. Carrying them about as individual, unconnected objects makes difficult finding them in a carrier's pocket or purse if there are several of such objects, especially with them having geometric outlines more or less similar to one another. Thus, people typically use some kind of organizing holder device to hold at least some of such carried about objects in some ordered arrangement.

A substantial variety of kinds of these holder devices are in current and past use. There are many kinds of key holders, for example, some having keys which swing out of the holder for use through rotating about a pivot of some sort, or about a ring, or swing with a ring that is somehow captured so as to allow that ring with the key to rotate. Other kinds of holders allow keys or other oblong objects to be slid in and out of the holder. Many of these holders are formed from a multitude of parts of different materials and which must be individually assembled in fabricating the holder structure. Often, mounting the oblong objects to be held in the holder is inconvenient, or even difficult, and many allow holding therein only very limited numbers of objects. Similarly, the means for selecting objects from the holder to thereby become accessible for use is often inconvenient or difficult. Thus, there is a desire for an economical and convenient oblong object holder that can accommodate a variety of different oblong objects therein.

SUMMARY

The present invention provides a holder of oblong objects pivotably mounted therein so as to be selectively positionable and selectively retainable therein comprising a pair of oblong sidewall structures spaced apart across an object retaining space from one another each having a mounting end such that a supporting one of the pair of sidewall structures has a divide extending therein partially along its length at the mounting end thereof to provide a pair of split sidewall spring sheets across the divide from one another with each of the pair of sidewall spring sheets having a sidewall spring opening therethrough such that the sidewall spring openings are also across from one another. An ejector mounted in the holder to be positioned in the object retaining space at an ejector side of the object retaining space to extend between the pair of spaced apart oblong sidewall structures with the ejector formed of a resilient material such that an end thereof can be forced further into the object retaining space and thereafter return to the ejector side when that forcing ceases. A pivot pin is positionable concurrently through each of the sidewall spring openings, and also removable therefrom.

BRIEF DESCRIPTION OF THE DRAWINGS

FIGS. 3A, 3B and 3C show three side views of a portion of the embodiment in FIG. 1 of the present invention, FIGS. 4A and 4B are side and bottom views of a portion of the embodiment shown in FIG. 1.

DETAILED DESCRIPTION

Figure 1:
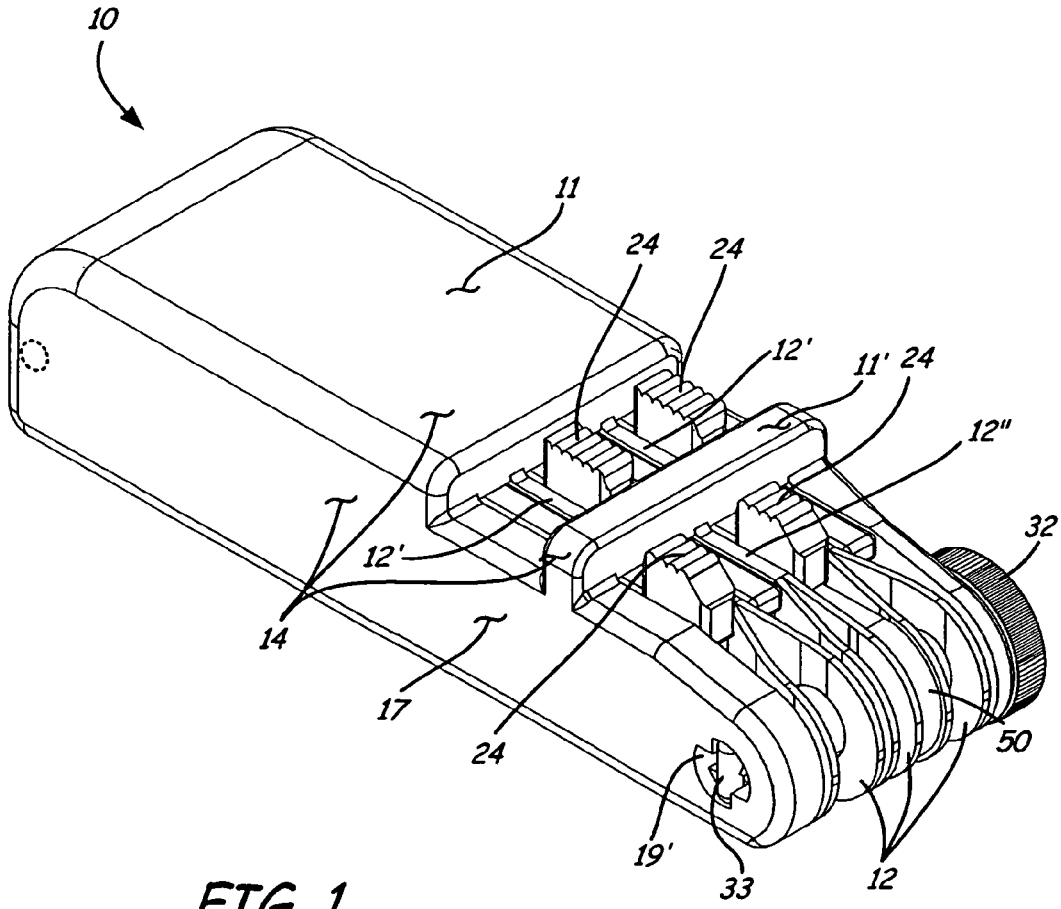
FIG. 1 shows an overhead perspective view of an embodiment of the present invention.
Figure 1A:
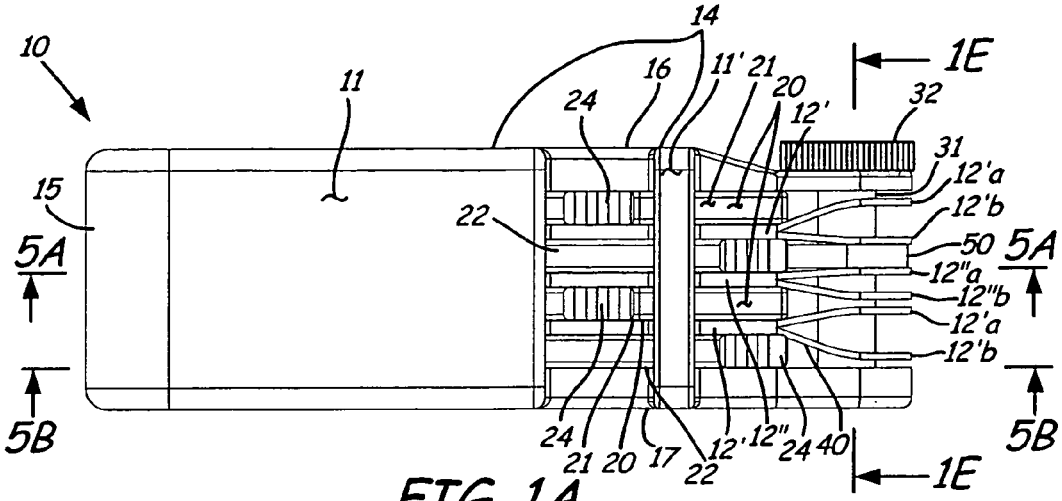
FIG. 1A shows a top view of the embodiment in FIG. 1 of the present invention.
Figure 1B:
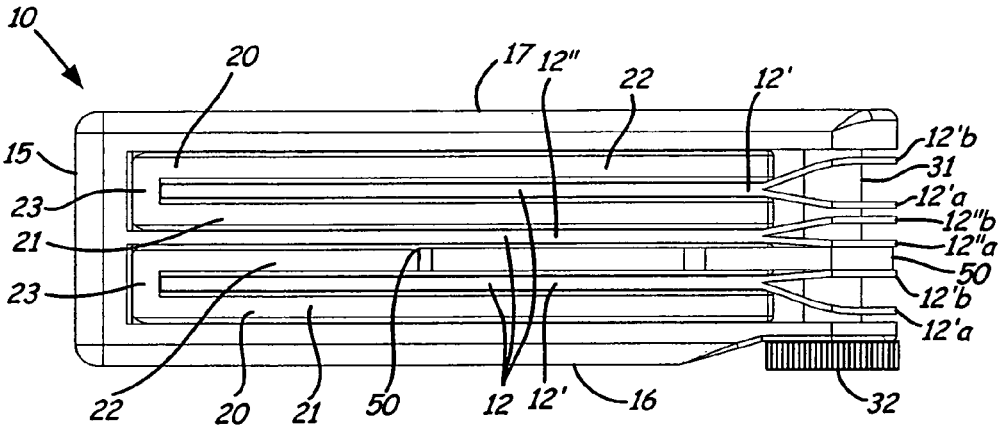
FIG. 1B shows a bottom view of the embodiment in FIG. 1 of the present invention.

FIG. 1 shows a perspective view of an example of the oblong object holder, 10, of the present invention, and FIG. 1 A shows a top view thereof with FIG. 1B showing a bottom view thereof. Holder 10 has a more or less rectangular solid shaped base plate, 11, with inner and outer major surfaces on either side thereof, and a base support dividing bar, 11', also an approximately rectangular solid with inner and outer major surfaces on either side thereof. Extending perpendicularly outward from the inner major surfaces of both base plate 11 and base support dividing bar 11', so as to extend parallel to one another, are the supported ends of a plurality of spaced apart separator slats, 12, and these slats also extend lengthwise perpendicularly past an exposed end edge of plate 11, and also past base support dividing bar 11' in cantilever fashion to thus have corresponding unsupported ends. Each of the unsupported separator slat ends diverges into a pair of slat springs each formed as a circular flat ring with a circular opening, 13, extending therethrough. Each of these circular flat rings is joined on one side thereof to the remainder of its slat to thereby form a slat spring, and all of opening 13 in these slat springs are coaxial with one another. Base plate 11, base support dividing bar 11' and separator slats 12 are portions of a housing, 14, typically formed of a somewhat resilient polyacetyl polymer or copolymer material.

In addition, in housing 14, there is an end side, 15, having an inner surface ridge, 15', (not shown in FIGS. 1, 1A or 1B but further described below) that extends therefrom near to, but spaced apart from, and parallel to plate 11, end side 15 being positioned at the enclosed end edge of plate 11, the edge opposite the exposed edge of plate 11. End side 15 perpendicularly joins two outer sides, 16 and 17, each positioned at a corresponding one of the remaining edges of plate 11, the side edges across plate 11 from one another. End side 15 and outer sides 16 and 17 also extend perpendicularly outward from the inner major surface of plate 11 at their base plate edge locations, and outer sides 16 and 17 also extend perpendicularly outward from the shorter sides of base support dividing bar 11'. Thus, base plate 11, end side 15, and dividing bar 11' each "bridge" across the space separating outer sides 16 and 17. Outer sides 16 and 17 also have unsupported ends extending parallel to the side edges of base plate 11, and so perpendicularly past the exposed end edge of plate 11, and also past base support dividing bar 11' in the same cantilever fashion followed by slats 12.

A dashed line circular opening is shown extending through side 17 of housing 14 in FIG. 1 near end side 15 as part of an alternative external device connecting arrangement which can be chosen to be or not be provided with holder 10. A similarly sized and positioned circular opening can then also extend through opposite side 16 across from the corresponding opening in side 17. Thus, a band or a ring or a chain can be inserted through both of these two openings to be used to attach a fob or other external object to holder 10. In a further addition or alternative, a ring-like structure extending outward from holder 10 can be formed integrally with, or attached to, the outer surface of end side 15 with the opening therethrough again through which a band or a ring or chain, or even a carabiner, can be inserted.

Separator slats 12 extend lengthwise perpendicular to end side 15, and have the supported ends thereof, located opposite the unsupported ends thereof, at the end side 15 region of base plate 11. Those two slats nearest outer sides 16 and 17, respectively, are spaced apart from end side 15. Those two of slats 12, and the further away slats in each of the succession of pairs of slats 12 between them in larger capacity holders than holder 10 shown, together form a group of positioning slats, 12', in the plurality of separator slats 12. Each of positioning slats 12' has between it and the next closest one thereto, or between it and each of the next closest ones thereto, another of the plurality of separator slats 12 not in the positioning slats group. The one such slat in holder 10 between two positioning slats 12', and all such slats between positioning slats in larger capacity holders than holder 10 shown, are joined to end side 15. These slats in the plurality of separator slats 12 that are each between a pair of positioning slats 12' form a group of structure slats, 12", in the plurality of separator slats 12.

As indicated above, all of slats 12, i.e. all of positioning slats 12' and all of structure slats 12", diverge at their unsupported ends into a pair of circular flat ring shaped slat springs, each with an opening 13 therethrough. In the figures, the slat spring in a each pair thereof nearest outer side 16 has been designated an "a" spring and the other pair member has been designated a "b" spring. In addition, they have their positioning and structure slat groups designations 12' and 12" so that the designations shown for slat springs are 12'*a*, 12'*b*, 12"*a* and 12"*b*. Slats 12 with these slat springs are molded such that these springs resiliently press against the adjacent one of slats 12, the outer or inner sides 16 and 17, or an oblong object captured in holder 10 adjacent such a slat spring.

Figure 1C:
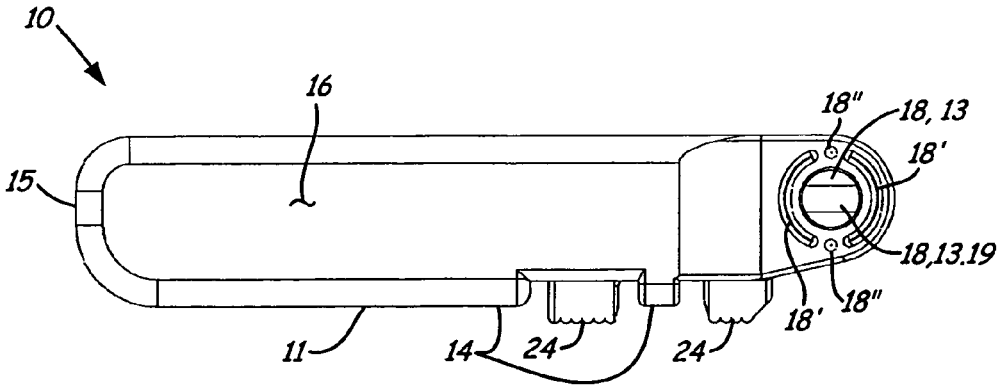
FIG. 1C shows a side view of a portion of the embodiment in FIG. 1 of the present invention.

The unsupported end of outer side 16 also has a circular entrance opening extending therethrough, 18, as can be seen in the partial disassembled side view of FIG. 1C (nothing shown in opening), that is coaxial with, and about the diameter of, circular slat openings 13. Outside, but concentric with opening 18, are two separated partial semicircular arc shaped recesses, 18', in outer side 16 with each having a cross section perpendicular to the surface of side 16 in the shape of half of a circular disk. Each of the recess semicircular arcs has the same radius but which is slightly larger than the radius of opening 18. Centered in each the separations between partial semicircular arc shaped recesses 18', at the same radial distance, is a hemispherical recess, 18".

Figure 1D:
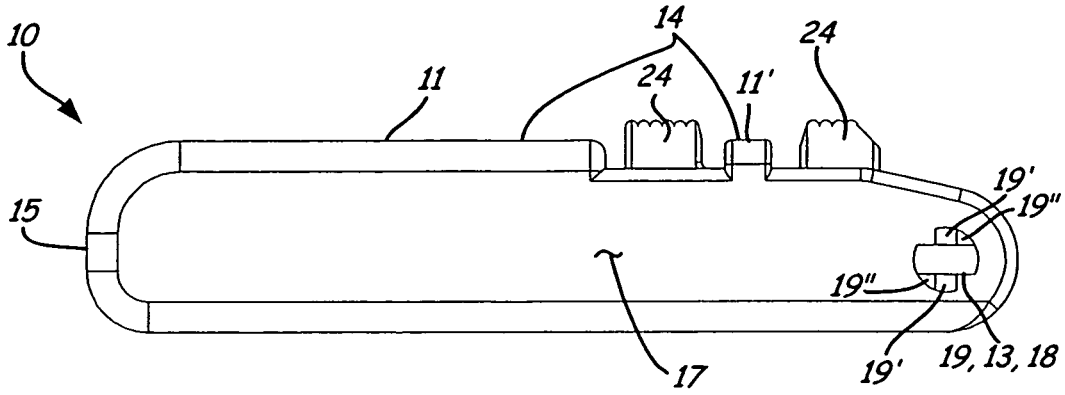
FIG. 1D shows another side view of a portion of the embodiment in FIG. 1 of the present invention, FIG. 1 E shows a cross section view of a further side of the embodiment in FIG. 1 of the present invention.

A slot opening, 19, extending through the unsupported end of outer side 17, can be seen in the partial disassembly side view of FIG. 1D (nothing shown in opening). Opening 19 extends lengthwise parallel to a diameter of opening 13 in the separator slat 12 adjacent thereto, and of a similar length, with the center of this slot opening coinciding with the common axis of symmetry of coaxial openings 13. Slot opening 19 is shaped as a rectangular slot opening but extended by a pair of half circular cylinder slot end openings each extending from a corresponding one of the opposite shorter sides of the rectangular slot opening, i.e. the short ends of this slot opening appear as circular arcs in FIG. 1D. There is a similarly shaped detent recess, 19', in outer side 17 at the outer surface thereof having its center coinciding with that of slot opening 19 but with the primary length of recess 19' extending perpendicularly to the primary length of slot opening 19 and approximately equal thereto.

In FIG. 1C, the complete outer side-to-outer side opening extending through entrance opening 18, slat openings 13, and slot opening 19 is designated 18, 13, 19, and the opening extending through opening 18 and slat openings 13 to the inner surface of outer wall 17 is designated 18, 13. Similarly, in FIG. 1D, the complete outer side-to-outer side opening extending through slot opening 19, slat openings 13, and entrance opening 18 is designated 19, 13, 18.

Figure 1E:
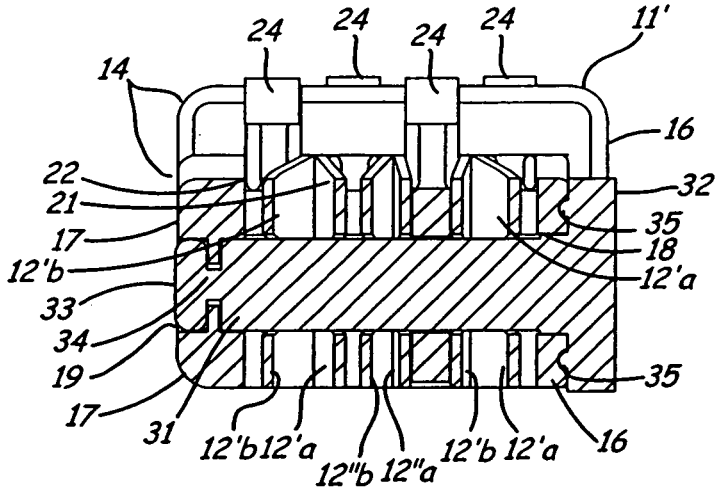

In addition, there are two turning clearance section recesses, 19", in outer side 17 opposite one another each extending between an outer portion of slot opening 19 and an adjacent outer portion of detent recess 19', and not extending into outer side 17 as deeply as detent recess 19'. Thus, each turning clearance section recess 19" two joined perpendicular straight sides, one set by slot opening 19 and one set by detent recess 19', with the remaining ends joined by a circular arc with a radius equal to half the length of opening 19. There further is a circular shaped recess at the inner surface of outer side 17 so as to effectively leave a reduced thickness integral wall structure about slot opening 19. Outer side openings 19 and 18 are further indicated in an end side cross section view in FIG. 1E.

Figure 2A:
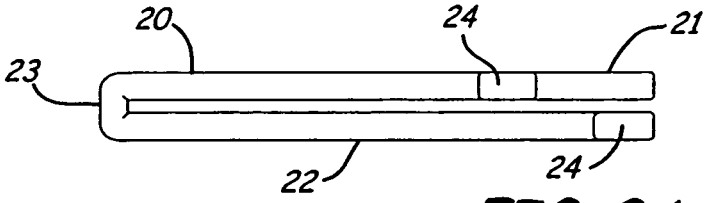
FIGS. 2A and 2B show top and side views of a portion of the embodiment in FIG. 1 of the present invention.
Figure 2B:
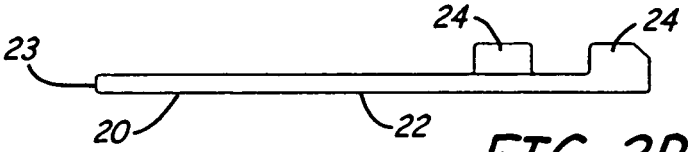

Two relatively resilient material U-shaped ejection members, 20, are provided in housing 14 with a representative one of them shown in the top and side views of FIGS. 2A and 2B. Each of ejection members 20 has two long side structures, 21 and 22, with each of those having a free end and a constrained end as opposite ends thereof. Structures 21 and 22 are positioned on either side of a corresponding one of positioning slats 12'. Each ejection member also has a short side structure, 23, joining together the two long side structures therein at the constrained ends of each. This short side structure is positioned between the supported end of that corresponding positioning slat and end side 15 of housing 14 and between ridge 15' and the inner surface of plate 11. Portions of long side structures 21 and 22 in each ejection member, and short side structure 23 thereof, are also positioned against the inner surfaces of base plate 11 and base support dividing bar 11'. The remaining portions of long side structures 21 and 22 have the free ends thereof extend past the exposed edge of base plate 11 and further past base support dividing bar 11'. Ejection members 20 typically formed of either a resilient polyacetyl polymer or copolymer material or a resilient polyamide polymer such as nylon.

There is, in addition in each of ejection members 20, two push bars, 24, each extending perpendicularly outward to and past the outer surface of base plate 11 from relatively near the free ends thereof and from the side of each of the two long side structures in that ejection member facing base support dividing bar 11'. Thus, there is a pair of push bars 24 provided for each ejection member 20, each extending from a corresponding one of long side structures 21 and 22. One of push bars 24 in the pair thereof in an ejection member 20 extends from long side structure 21 in that member on the base plate 11 side of base support dividing bar 11' relatively far from the free end of that long side structure, and the other of push bars 24 in the pair extends from long side structure 22 in that member on the opposite side of base support dividing bar 11' relatively near the free end of that long side structure. Thus, base support dividing bar 11' divides the space between push bars 24 in each of ejection members 20 as assembled in housing 14 of holder 10, and aids in preventing items passing across these bars from snagging them (though this dividing bar is not required to be present in holder 10). The last described push bar near the free end of long side structure 22 also has a chamfer beginning at its outermost surface angled toward that long side structure free end to further aid in its avoiding any snagging of interior material surfaces passing thereby as may occur with any containing arrangement into which holder 10 is inserted such as a pocket or a purse.

A locking pin, 30, is provided for extending through openings 18, 13 and 19 to capture and hold oblong objects, such as keys, having capture openings in them through which pin 30 can also extend, and shown in the three side views of FIGS. 3A, 3B and 3C. Locking pin 30 has a main circular cylindrical shaft, 31, and has one end thereof ringed with a slightly greater diameter ring strip, 31', thereabout that, nevertheless, has a diameter slightly less than that of opening 18 in outer side 16 into which it will be inserted during use. This ringed end 31' of main shaft 31 is attached to a disk shaped, outer edge knurled, knob, 32, having a diameter larger than that of shaft 31 and ring strip 31'.

The length of shaft 31 is sufficient to have the opposite end thereof extend into the circular shaped recess at the inner surface of outer side 17 to thereby support that end of the shaft in side 17. The opposite end of shaft 31 is also attached to a locking bar, 33, extending in length parallel to a diameter of main shaft 31. Locking bar 33 is attached to main shaft 31 by a reduced diameter circular cylindrical subshaft, 34, having its axis of symmetry coaxial with the axis of symmetry of main shaft 31. The length of locking bar 33 is just slightly less than the length of slot opening 19 and of detent recess 19', and the length of subshaft 34 is just slightly less than the thickness of the material in outer wall 17 at sector recesses 19". The support provided by side 17 to shaft 31, because of extension of shaft 31 into the circular shaped recess at the inner surface of outer side 17, aids in isolating locking bar 33 and subshaft 34 from lateral forces that they would be less able than shaft 31 to withstand because of their smaller cross sectional dimensions. However, in some alternatives, this circular shaped recess at the inner surface of outer side 17 can be omitted with one such alternative being the omission of locking bar 33 and provision of screw threads on subshaft 34 and along the surface of an interior opening in outer side 17, extending therein from the inner surface of side 17. This latter arrangement thereby allows locking pin 30 to extend through outer side 16 to be screwed into outer side 17.

Two hemispherical protrusions, 35, extend toward locking bar 33 from the interior disk surface of knurled knob 32 at a radius from the axis of symmetry of shaft 31 equal to the radius to the positions of hemispherical recesses 18" in the outer surface of outer side 16. The radii of protrusions 35 are slightly less than the radii of recesses 18" and also slightly less than the radii of the cross section half circular disks partial semicircular arc shaped recesses 18'. Locking pin 30 is typically formed of a relatively stiff polyamide polymer such as nylon.

Capturing an oblong object such as a key in holder 10 starts by positioning, as an example, a key, 50, between the adjacent slat springs of two adjacent separator slats 12, as shown in the example of FIG. 1, or between one of the outer sides 16 and 17 and the nearest slat spring of an adjacent separator slat 12, and with the key capture opening provided in key 50 substantially coaxially aligned with slat spring openings 13 and outer end openings 18 and 19. These slat springs are clearly seen in the side and bottom views of housing 14 in FIGS. 4A and 4B. The locking bar 33 end of locking pin 30 is then inserted through outer side entrance opening 18, slat 12 openings 13 and the key capture opening, and finally through outer side slot opening 19. Insertion of locking bar 33 through slot opening 19 requires that bar 33 be aligned with slot opening 19 which will also result in hemispherical protrusions 35 each being in a corresponding one of the two separated partial semicircular shaped recesses 18' in outer side 16. Knurled knob 32 is then rotated to thereby rotate main shaft 31 and locking bar 33 to result in locking bar 33 being positioned in detent recess 19' to thereby restrain locking pin 30 to remain in that position and capture the key in holder 10, and concurrently results in hemispherical protrusions 35 extending inward from knob 32 each being in a corresponding one of the two hemispherical recesses 18".

Figure 5A:
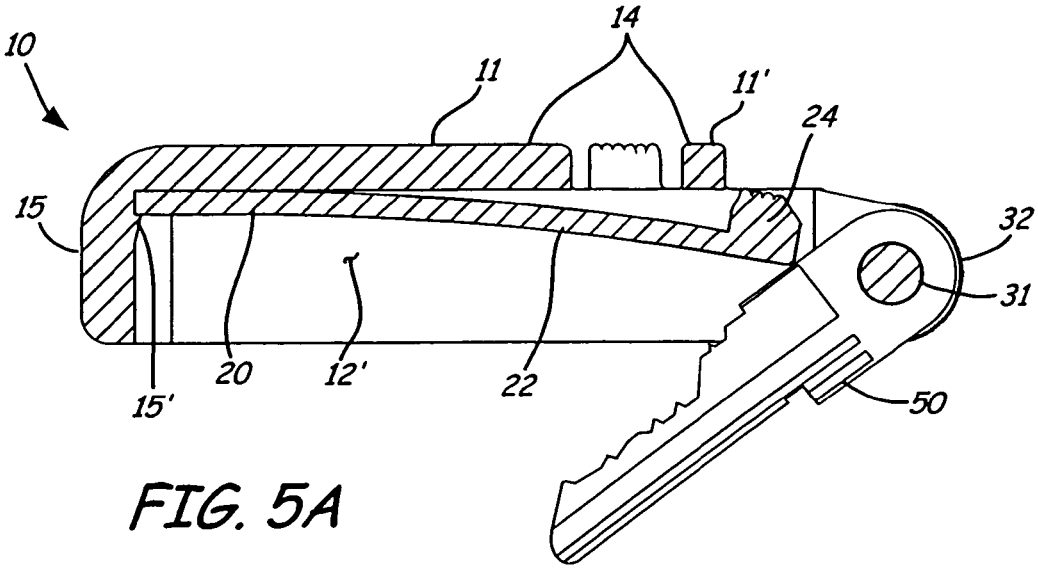
FIG. 5A shows a side cross section view of the embodiment in FIG. 1 of the present invention.
Figure 5B:
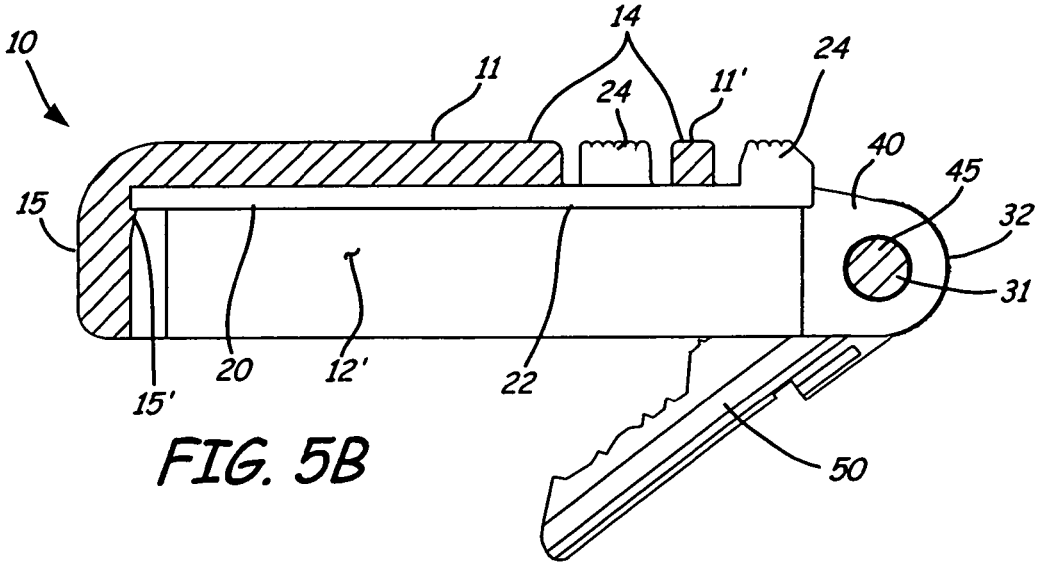
FIG. 5B shows another cross section view of the embodiment in FIG. 1 of the present invention from the same side as that shown in FIG. 5A.

Positioning captured key 50 for use once it has been captured on locking pin 30 is indicated in the side cross section views of FIGS. 5A and 5B (where also inner surface ridge 15' is shown), and merely requires the pushing inward into housing 14, to a location at or inside of dividing bar 11', the corresponding one of push bars 24 on the ejection member 20 having a long side structure 21 or 22 thereof immediately adjacent to that key. This pushing is against the frictional force that results from the adjacent ones of slat springs 12"*a*, 121), 12"*a* and 12"*b*, provided in the adjacent ones of slats 12 between which key 50 has been captured, resiliently pressing against key 50. The opposite side of that long side structure from the push bar being pushed is thereby forced against key 50 to cause it to rotate about main shaft 31 of locking bar 30 against the slat spring supplied frictional force to thereby be partially outside of housing 14 from where it can easily be rotated further, or forced into a keyhole of a lock, or both. Once holder 10 is rotated with key 50 in a keyhole of a lock to thereby unlock that lock, key 50 can be then withdrawn and rotated about locking pin 30 by pushing on the exposed portion of key 50 to force it against the slat spring supplied frictional force back into housing 14 to be entirely within the space between the two adjacent ones of slats 12.

The resiliency of housing 14 and the slat springs limits the torque to a degree which the user, through rotating holder 10, can apply to key 50 to thereby reduce the risk of the user's force breaking the extended portion of that key from its base. The resiliency of housing 14 is due to the polymer material of which it is constructed, a material that also reduces accumulations of, and transfers of, static electricity and similarly in ejection members 20.

Holder 10 has been shown and described with oblong objects such as keys captured therein by locking pin 30 at one end thereof. However, capturing such objects at two opposite ends thereof to allow holding more of them in a single holder can be accomplished by joining housings 14 of two of holders 10 at the outer surface of end walls 15 of each so as to have the holders extend in opposite directions from such a joint, or by integrally forming those end walls together as a common end wall with a resulting similar structural geometry in the resulting housing arrangement. Alternatively, two of such holders 10 could be reconfigured with end walls 15 omitted and then joined together at the remaining portions of housings 14 such as outer walls 16 and 17 and perhaps base plates 11, or again forming them integrally with a resulting similar structural geometry in the resulting housing arrangement. In this latter alternative, short side structure 23 of ejection members 20 from both of such holders 10 could be merged into a single bar so as to leave push bars 24 in each spaced apart from those push bars adjacent thereto to thereby form a double sided comb-like structure. Thus, the push bars on each side of the single bar, extending in opposite directions as "teeth" in these two comb structures, are affixed to, or integrally formed with, this common single bar that extends perpendicularly to the push bars and the resulting double sided comb-like structure is suitably held again in the resulting housing.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A holder of oblong objects pivotably mounted therein so as to be selectively positionable and selectively retainable therein, said holder comprising:

a pair of oblong sidewall structures spaced apart across an object retaining space from one another each having a mounting end such that a supporting one of said pair of sidewall structures has a divide extending therein partially along its length at said mounting end thereof to provide a pair of split circular ring shaped sidewall spring sheets across said divide from one another with each of said pair of circular ring shaped sidewall spring sheets having a sidewall spring opening therethrough such that said sidewall spring openings are also across from one another to engage an oblong object, wherein that remaining one of said pair of sidewall structures has a sidewall opening therethrough at said mounting side end thereof across from said sidewall spring openings and has an opposite end thereof joined with an end support wall, an ejector mounted in said holder to be positioned in said object retaining space at an ejector side of said object retaining space to extend between said pair of spaced apart oblong sidewall structures with said ejector formed of a resilient material such that an end thereof can be forced further into said object retaining space and thereafter return to said ejector side when said forcing ceases, a pivot pin positionable concurrently through each of said sidewall spring openings, and also removable therefrom, and wherein said divide is a first divide, said pair of split sidewall spring sheets are a first pair of split sidewall spring sheets, and each having a said pair of sidewall structures is a first pair of sidewall structures and said object retaining space is a first object retaining space and said support sidewall structure is spaced apart from said end wall support by a first ejector space, and further comprising a plurality of sidewall structure pairs each formed of a pair of oblong sidewall structures spaced apart across an object retaining space from one another and each having a mounting side end across from one another, and each having a divide extending therein partially along its length at said mounting end thereof to provide a pair of split sidewall spring sheets across said divide from one another with each of said pair of sidewall spring sheet having a sidewall spring opening therethrough such that said sidewall spring openings are also across from one another, there being a separator sidewall structure in each sidewall structure pair having an opposite end thereof joined with said end support wall and an accommodating sidewall structure therein having an opposite end thereof spaced apart from said end support wall by an ejector space, said separator sidewall structure in each of said plurality of sidewall structure pairs being spaced apart from said accommodating sidewall structure in an adjacent sidewall structure pair, including said accommodating sidewall structure in said first adjacent sidewall structure pair, by a corresponding object retaining space.

2. The device of claim 1 wherein said sidewall spring openings have opposite sides thereof separated by distances larger than those distances separating opposite sides of said sidewall opening.

3. The device of claim 1 wherein said ejector is a first ejector that is curved sufficiently to form a joined ejector end thereof with a pair of ejector sides across from one another each extending away from said joined ejector end to each have a free end across from one another so that said first ejector mounted in said holder with said joined end thereof in said first ejector space to have one of said first ejector sides positioned in said first object retaining space at an ejector side of said first object retaining space to extend between said first pair of sidewall structures and to have that remaining one of said first ejector sides positioned in said corresponding object retaining space at an ejector side thereof to extend between said accommodating sidewall structure in said first sidewall structure pair and said separator sidewall structure in said adjacent sidewall structure pair, and further comprising a plurality of ejectors each curved sufficiently to form a joined ejector end thereof with a pair of ejector sides across from one another each extending away from said joined ejector end to each have a free end across from one another so that each said ejector in said plurality thereof is mounted in said holder with said joined end thereof in a corresponding said ejector space to have one side thereof positioned in said object retaining space at an ejector side thereof in a corresponding one of said plurality of sidewall structure pairs to extend between said sidewall structures therein and to have that remaining one of said ejector sides positioned in said corresponding object retaining space at an ejector side thereof to extend between said accommodating sidewall structure in said adjacent sidewall structure pair and said separator sidewall structure in said corresponding sidewall structure pair, each said ejector in said plurality thereof formed of a resilient material such that an end thereof can be forced further into said object retaining space in which it is positioned and thereafter return to said ejector side thereof when said forcing ceases.

4. The device of claim 3 wherein at least a portion of a said ejector space is formed by a recess in said end wall support.

5. The device of claim 4 wherein a said joined ejector end of a said ejector is at least partially in said recess in said end wall support.

6. The device of claim 5 wherein said joined ejector end of said ejector at least partially in said recess in said end wall support is constrained toward remaining there by a side of said recess pressing on said joined ejector end of said ejector.

7. The device of claim 3 wherein said remaining one of said first pair of sidewall structures is a first outer sidewall and further comprising a second outer sidewall formed of an oblong sidewall structure spaced apart across a last object retaining space from that said one of said plurality of sidewall structures nearest to said second outer sidewall with all of said plurality of sidewall structures positioned between said first and second outer sidewalls, said second outer sidewall having a retainer shaft opening therein at said mounting side end thereof between an inner surface thereof across from said sidewall spring openings and an outer surface thereof on an opposite side of said second outer sidewall and said second outer sidewall further having an opposite end thereof joined with said end support wall.

8. The device of claim 7 further comprising said first and second outer sidewalls being further joined by a dividing bar near said mounting side ends thereof adjacent said ejectors with said ejectors having an ejector button extending outward from each of said ejector sides thereof to be alongside said dividing bar such that said ejector buttons on said ejector sides of an ejector are on alternate sides of said dividing bar.

9. The device of claim 7 wherein said pivot pin is positionable concurrently through each of said sidewall spring openings, said sidewall opening and said retainer shaft opening, and being further positionable when extending through these said openings to have a portion thereof blocked against being removed from these said openings by at least one of said first and second outer sidewalls, and also thereafter there being repositionable to be removable therefrom.

10. The device of claim 9 wherein said retainer shaft opening has a smaller diameter than do said sidewall opening and said pin support opening, and said sidewall opening and said pin support opening each have a smaller diameter than do said sidewall spring openings with said retainer shaft opening extending partially through said second outer sidewall from said pin support opening to join a locking opening extending partially through said second outer sidewall from said outer side thereof, said locking opening having opposite sides thereof separated by distances larger than those distances separating opposite sides of said retainer shaft opening, and wherein said pivot pin comprises a key support shaft and a retainer shaft having a free end and having a joined end that is concentrically joined with said key support shaft at a locking end of said pivot pin with said retainer shaft and said retainer shaft opening each having a smaller diameter than said key support shaft, said retainer shaft being longer than said retainer shaft opening so, with said pivot pin positioned concurrently through each of said sidewall spring openings and through said sidewall opening and in said pin support opening, said retainer shaft extends into said lock opening through said retainer shaft opening, said retainer shaft having a protuberance thereon at a side thereof past its diameter at said free end thereof which can be positioned entirely within said locking opening and with said retainer shaft opening having an accommodation opening alongside thereof to form a retainer shaft combined opening such that said retainer shaft with said protuberance thereon can pass through said combined opening.

11. The device of claim 10 wherein said pivot pin, at an operating end thereof opposite said locking end thereof, has a protuberance on said key shaft thereof at a side thereof past its diameter so, with said pivot pin positioned concurrently through each of said spring openings and through said sidewall opening and said retainer shaft extending into said lock opening through said retainer shaft opening, said protuberance is entirely outside of an outer side of said first outer sidewall opposite that side thereof adjacent to said first pair of sidewall structures, said protuberance having a portion thereof selectively extending into one of a channel and separated recess formed in said outer wall of said first outer sidewall.

* * * * *